US011788172B1

(12) United States Patent
You et al.

(10) Patent No.: US 11,788,172 B1
(45) Date of Patent: Oct. 17, 2023

(54) PREPARATION METHOD OF MAGNESIUM MATRIX COMPOSITE REINFORCED WITH SILICON CARBIDE PARTICLES

(71) Applicant: Taiyuan University of Technology, Taiyuan (CN)

(72) Inventors: Zhiyong You, Taiyuan (CN); Aoxue Jiang, Taiyuan (CN)

(73) Assignee: Taiyuan University of Technology, Taiyuan (CN)

( * ) Notice: Subject to any disclaimer, the term of this patent is extended or adjusted under 35 U.S.C. 154(b) by 0 days.

(21) Appl. No.: 18/316,300

(22) Filed: May 12, 2023

(30) Foreign Application Priority Data

Sep. 27, 2022 (CN) ..... 202211188438.8

(51) Int. Cl.
*C22C 1/10* (2023.01)
*C22C 23/02* (2006.01)

(52) U.S. Cl.
CPC ..... *C22C 1/1068* (2013.01); *C22C 1/1005* (2013.01); *C22C 1/1047* (2023.01); *C22C 23/02* (2013.01)

(58) Field of Classification Search
CPC ... C22C 1/1068; C22C 1/1047; C22C 1/1005; C22C 23/02
See application file for complete search history.

(56) References Cited

U.S. PATENT DOCUMENTS

2005/0016638 A1 1/2005 Kondoh

FOREIGN PATENT DOCUMENTS

CN 108796262 A 11/2018
CN 109290794 A 2/2019
JP 2018040034 A 3/2018

*Primary Examiner* — Alexandra M Moore
(74) *Attorney, Agent, or Firm* — Kaplan Breyer Schwarz, LLP; Stuart H. Mayer

(57) ABSTRACT

Disclosed is a preparation method of a magnesium matrix composite reinforced with SiC particles, belonging to the technical field of metallurgical materials, including the following steps: (1) carrying out oxidation pretreatment on SiC particles; (2) laying a piece of magnesium alloy on a bottom, laying a layer of oxidized SiC particles, then repeating a laying operation of a layer of magnesium alloy and a layer of SiC particles until the magnesium alloy and the SiC particles are completely laid, introducing inert gases, heating and melting, then performing cinder scrapping; (3) cooling to a semisolid temperature of the magnesium alloys for semisolid mechanical stirring, heating, and mechanically stirring again; (4) cooling again to the semisolid temperature of the magnesium alloys, then casting into a blank; and (5) heating the blank to the semisolid temperature of the magnesium alloys and extruding to obtain the magnesium matrix composite reinforced with SiC particles.

3 Claims, 6 Drawing Sheets

PREPARATION METHOD OF MAGNESIUM MATRIX COMPOSITE REINFORCED WITH SILICON CARBIDE PARTICLES

CROSS-REFERENCE TO RELATED APPLICATIONS

This application claims priority to Chinese Patent Application No. 202211188438.8, filed on Sep. 27, 2022, the contents of which are hereby incorporated by reference.

TECHNICAL FIELD

The present application belongs to the technical field of metallurgical materials, and particularly relates to a preparation method of a magnesium matrix composite reinforced with silicon carbide (SiC) particles.

BACKGROUND

Magnesium matrix composite reinforced with particles are widely used in the aerospace, automotive and electronics industries for their high specific strength, specific stiffness and excellent wear resistance. A method for preparing the magnesium matrix composite reinforced with particles is to mechanically stirring and casting, which is simple in process with no restriction on the size of the ingot as well as applicable for mass production. However, the particles of magnesium matrix composites reinforced by particles prepared by the mechanical stirring method are prone to agglomeration in the matrix, and a large number of pores are easily induced in the castings as a result of gas entrapment. Therefore, there arises a technical problem to be solved in the field of preventing uneven distribution or agglomeration of particles in the matrix when using particles for reinforcement of the matrix.

SUMMARY

To address the above-mentioned problems in the prior art, the present application incorporates extrusion strengthening and enhanced phase strengthening to further investigate the effect of silicon carbide (SiC) particles on the microstructure of magnesium alloys, and provides a method that eliminates the step of adding SiC particles to the magnesium alloy melt, preventing SiC particles from floating easily above the melt and causing uneven distribution or agglomeration of SiC particles.

In order to achieve the above objectives, the present application provides the following technical schemes:

a preparation method of a magnesium matrix composite reinforced with SiC particles, including steps as follows:

(1) carrying out oxidation pretreatment on SiC particles;

(2) laying a piece of magnesium alloy on a bottom, laying a layer of oxidized SiC particles obtained in the step (1), then repeating a laying operation of a layer of magnesium alloy and a layer of the oxidized SiC particles until the magnesium alloy and the oxidized SiC particles are completely laid, introducing inert gas, heating and melting, and performing cinder scrapping;

(3) cooling to a semisolid temperature of the magnesium alloy for semisolid mechanical stirring, heating, and mechanically stirring again;

(4) cooling again to the semisolid temperature of the magnesium alloy, then casting into a blank; and (5) heating the blank to the semisolid temperature of the magnesium alloy and extruding to obtain the magnesium matrix composite reinforced with SiC particles.

Optionally, in the step (1), the oxidation pretreatment includes oxidation at 1,200 degrees Celsius (° C.) for 1 hour (h).

Optionally, in the step (2), the inert gas is a $CO_2/SF_6$ mixed gas with a volume ratio of 6:1; and heating includes a process of heating to a temperature of 740° C. to completely melt the magnesium alloy then performing cinder scrapping.

Optionally, in the step (3), the semisolid mechanical stirring includes stirring for a duration of 30 minutes (min) with a stirring speed of 400 revolutions per minute (r/min); the semisolid temperature is 585° C.; the heating is to increase the temperature to 720° C.; and the mechanically stirring again includes stirring for a duration of 5 min with a stirring speed of 400 r/min.

Optionally, in the step (4), a temperature is kept for 15 min before cooling.

Optionally, in the step (5), the extruding includes conditions of: extrusion pressure of 2,000 kilonewtons (KN), extrusion speed of 1 millimeter per second (mm/s), and pressure holding of 1 min.

Optionally, the oxidized SiC particles are in a mass ratio of 3:17 to the magnesium alloy, and in the step (2), each layer of oxidized SiC particles has a thickness of 1-2 mm, and each layer of magnesium alloy has a thickness of 10-15 mm, with a top layer of magnesium alloy.

The present application also provides a magnesium matrix composite reinforced with SiC particles prepared by the preparation method.

As a ceramic phase, SiC particles possess high hardness, good wear resistance and relatively high thermal stability in the magnesium melt, which makes it a commonly used material for particle reinforcement of magnesium alloys owing to its thermodynamic stability in pure magnesium.

Semisolid extrusion has the advantages of casting forging, which can improve the interfacial bonding between the reinforcing particles and the matrix metal, reduce the porosity of metal matrix composites and effectively refine the primary matrix phase, making it an effective method to improve the properties of metal matrix composites reinforced with particles prepared by stirring casting.

Compared with the prior art, the present application has the following beneficial effects:

the preparation method of the present application is simple, as it prevents SiC particles from floating on top of the melt and eliminates the steps of adding SiC particles to the molten magnesium melt in batches, resulting in a reduced risk of operation; it adopts the commonly used mechanical stirring process, which is easy to start and operate, and the equipment is inexpensive and only costs a short time for electricity when used; and The SiC particles added to the present application are more uniformly distributed in the structure of the magnesium alloy, and the bonding strength of the SiC particles to the matrix is further improved by semisolid extrusion, which also improves the mechanical properties of the magnesium alloy while optimizing the structure.

BRIEF DESCRIPTION OF THE DRAWINGS

For a clearer illustration of the technical schemes in the embodiments of the present application or in the prior art, a brief description of the accompanying drawings to be used in the embodiments are given below. It is obvious that the accompanying drawings in the following description are only some embodiments of the present application and that other accompanying drawings are available to those of ordinary skill in the art without any creative effort.

DETAILED DESCRIPTION OF THE EMBODIMENTS

Various exemplary embodiments of the present application are now described in detail and this detailed description should not be considered as limiting the present application, but should be understood as a more detailed description of certain aspects, features and embodiments of the present application. It should be understood that the terms described in the present application are intended to describe particular embodiments only and are not intended to limit the present application.

Furthermore, with respect to the range of values in the present application, it is to be understood that each intermediate value between the upper and lower limits of the range is also specifically disclosed. Each smaller range between any stated value or intermediate value within a stated range and any other stated value or intermediate value within a stated range is also included in the present application. The upper and lower limits of these smaller ranges may be independently included or excluded from the scope.

Unless otherwise stated, all technical and scientific terms used herein have the same meaning as is commonly understood by those of ordinary skill in the field described in the present application. Although the present application describes only preferred methods and materials, any methods and materials similar or equivalent to those described herein may also be used in the implementation or testing of the present application. All literature referred to in this specification is incorporated by reference for the purpose of disclosing and describing the methods and/or materials associated with the literature. In the event of conflict with any incorporated literature, the contents of this specification shall prevail.

Without departing from the scope or spirit of the present application, various improvements and variations can be made to specific embodiments of the specification of the present application, as will be apparent to those skilled in the art. Other embodiments obtained from the specification of the present application are obvious to the skilled person. The specification and embodiments of the present application are exemplary only.

As used herein, the words "comprising", "including", "having", "containing", etc., are open-ended terms, i.e. meaning including but not limited to.

The present application adopts a commercial product of AZ91D magnesium alloy.

The AZ91D magnesium alloy and/or SiC particles are added in a total addition amount of 500 grams (g) in the following embodiments and comparative embodiments.

Figure 6:
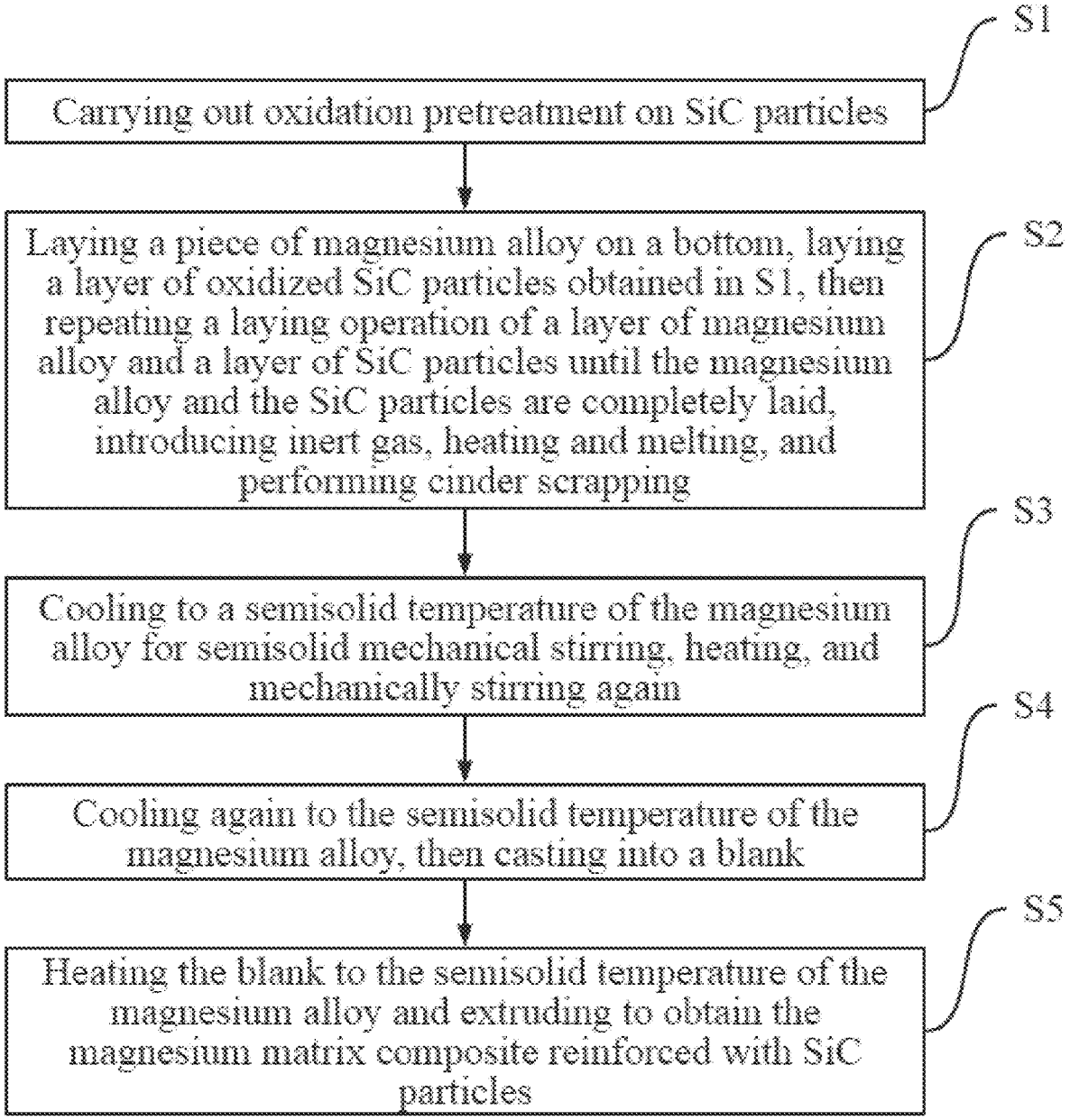
FIG. 6 shows a process of a preparation method of magnesium matrix composite reinforced with SiC particles according to the present application.

FIG. 6 shows a process of a preparation method of magnesium matrix composite reinforced with SiC particles, including steps as follows:

S1, carrying out oxidation pretreatment on SiC particles;

S2, laying a piece of magnesium alloy on a bottom, laying a layer of oxidized SiC particles obtained in the S1, then repeating a laying operation of a layer of magnesium alloy and a layer of the oxidized SiC particles until the magnesium alloy and the oxidized SiC particles are completely laid (with a top layer of magnesium alloy), introducing inert gas, heating and melting, and performing cinder scrapping;

S3, cooling to a semisolid temperature of the magnesium alloy for semisolid mechanical stirring, heating, and mechanically stirring again;

S4, cooling again to the semisolid temperature of the magnesium alloy, then casting into a blank; and S5, heating the blank to the semisolid temperature of the magnesium alloy and extruding to obtain the magnesium matrix composite reinforced with SiC particles.

In some preferred embodiments, the oxidation pretreatment in S1 includes oxidation at 1,200 degrees Celsius (° C.) for 1 hour (h);

in the S2, the inert gas is a $CO_2/SF_6$ mixed gas with a volume ratio of 6:1; and heating includes a process of heating to a temperature of 740° C. to completely melt the magnesium alloy then performing cinder scrapping; the oxidized SiC particles are in a mass ratio of 3:17 to the magnesium alloy, each layer of the oxidized SiC particles has a thickness of 1-2 millimeters (mm), and each layer of magnesium alloy has a thickness of 10-15 mm, with a top layer of magnesium alloy;

in the S3, the semisolid mechanical stirring includes stirring for a duration of 30 minutes (min) with a stirring speed of 400 revolutions per minute (r/min); the semisolid temperature is 585° C.; the heating is heat to 720° C.; and the mechanically stirring again includes stirring for a duration of 5 min with a stirring speed of 400 r/min;

in the S4, a temperature is kept for 15 min before cooling; and in the S5, the extruding includes conditions of: extrusion pressure of 2,000 kilonewtons (KN), extrusion speed of 1 millimeter per second (mm/s), and pressure holding of 1 min.

The present application also provides a magnesium matrix composite reinforced with SiC particles prepared by the preparation method.

Embodiment 1

Figure 1:
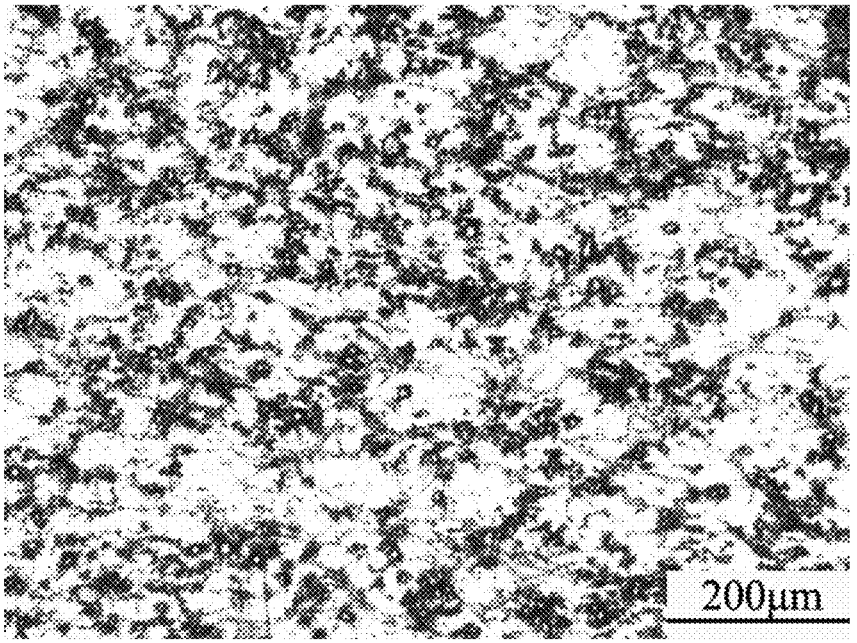
FIG. 1 shows a microstructure diagram of an extruded deformed magnesium matrix composite reinforced with silicon carbide (SiC) particles obtained in Embodiment 1 of the present application.

(1) Firstly, washing SiC particles with alcohol and drying in an incubator at 200° C. for 2 h, and then oxidizing at 1,200° C. for 1 h;

(2) putting a crucible into a resistance furnace and preheating to 400° C.;

(3) laying a uniformly cut 12 mm thick piece of AZ91D magnesium alloy on a bottom of the crucible, laying a 1.5 mm thick layer of oxidized SiC particles, then repeating a laying operation of a layer of AZ91D magnesium alloy and a layer of oxidized SiC particles (a layer of aluminium foil can be used as a support for the oxidized SiC particles if the layer of magnesium alloy is not even on the surface) until the magnesium alloy and the oxidized SiC particles are completely laid (with a top layer of magnesium alloy), where the oxidized SiC particles are added at a mass fraction of 15% of the total amount of AZ91D magnesium alloy and the oxidized SiC particles, i.e. a mass of 75 g, the rest is AZ91D magnesium alloy with a mass of 425 g; introducing an inert gas of $CO_2$/SF 6 with a volume ratio of 6:1 to prevent the magnesium alloy from burning, and then heating to 740° C. to completely melt the magnesium alloy then performing cinder scrapping;

(4) cooling a SiC/AZ91D magnesium alloy melt to a semisolid temperature of 585° C., and mechanically stirring for 30 min at a stirring speed of 400 r/min; then raising that temperature to a liquid temperature of 720° C., and mechanically stirring again for a stirring duration of 5 min at 400 r/min; after stirring, keeping the temperature for 15 min;

(5) cooling again to the semisolid temperature of 585° C., and casting into a copper mold to obtain a SiC/AZ91D blank; and (6) heating the SiC/AZ91D blank to the semisolid temperature of 585° C. for the second time, then extruding by a presser with an extrusion force of 2,000 kilonewtons (KN), an extrusion speed of 1 mm/s and pressure holding of 1 min; obtaining a magnesium matrix composite after extrusion, with a microstructure as shown in FIG. 1.

Comparative Embodiment 1

(1) Putting a crucible into a resistance furnace and preheating to 400° C.;

(2) using AZ91D as the magnesium alloy, placing 500 g of AZ91D magnesium alloy in the crucible; introducing $CO_2/SF_6$ inert gas with a volume ratio of 6:1 to prevent the magnesium alloy from burning, then heating to 740° C. for complete melting and performing cinder scrapping.

Figure 2:
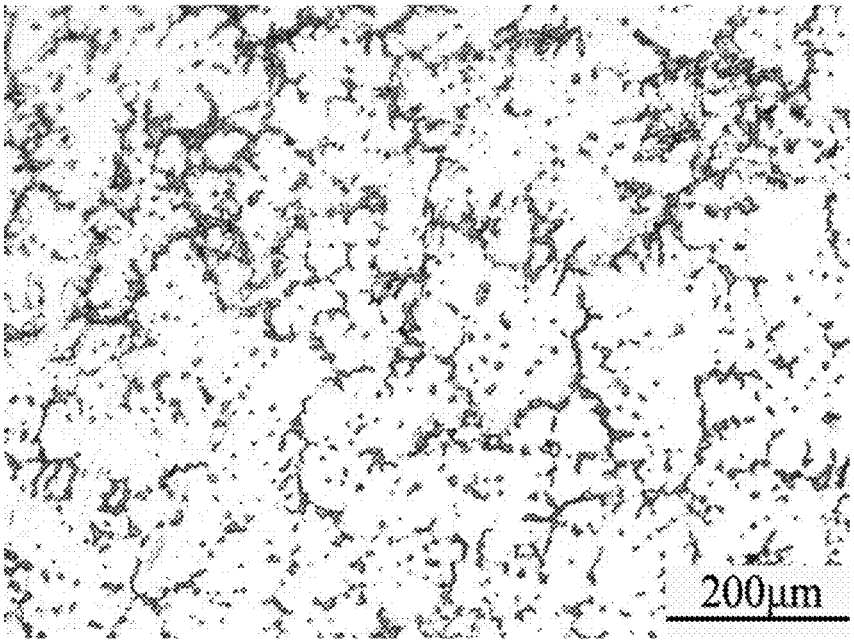
FIG. 2 shows a microstructure diagram of an extruded deformed magnesium matrix composite reinforced with SiC particles obtained in Comparative embodiment 1 of the present application.

(3) cooling the AZ91D magnesium alloy melt to the semisolid temperature of 585° C., and mechanically stirring for 30 min at a stirring speed of 400 r/min; then raising that temperature to the liquid temperature of 720° C., and mechanically stirring again, where the stirring duration is 5 min, and the stirring speed is 400 r/min; after stirring, keeping the temperature for 15 min;

(4) cooling to the semisolid temperature of 585° C., and casting into a copper mold to obtain an AZ91D blank;

(5) heating the AZ91D blank to the semisolid temperature of 585° C. for the second time, then extruding by a presser with an extrusion force of 2,000 KN, an extrusion speed of 1 mm/s and pressure holding of 1 min; and obtaining a finished product of magnesium matrix composite after extrusion, with a microstructure as shown in FIG. 2.

Comparative Embodiment 2

Same as Embodiment 1, with the difference that step (1) includes: washing the SiC particles with alcohol and drying them in an incubator at a temperature of 200° C. for 2 h, followed by preheating at 600° C. for 1 h.

Figure 3:
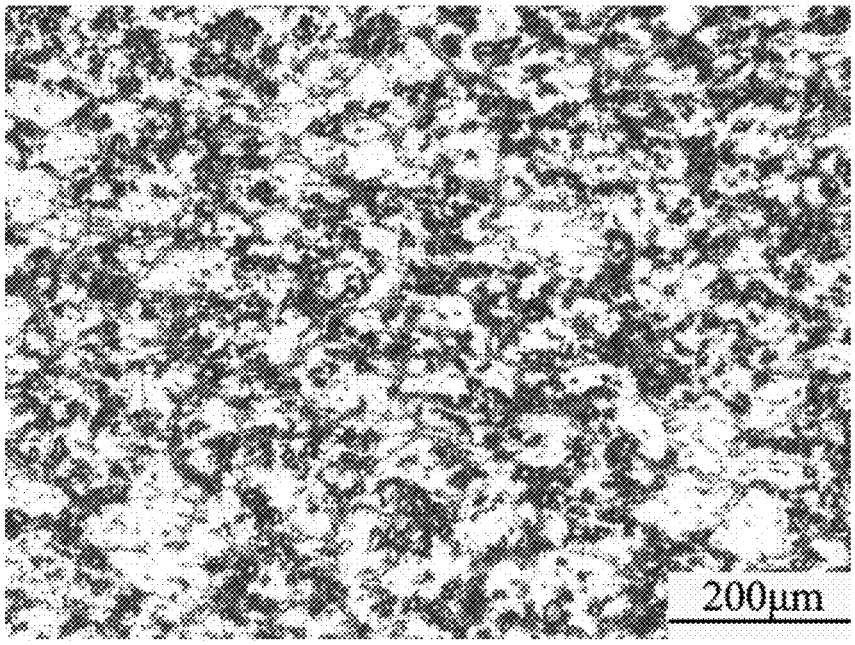
FIG. 3 shows a microstructure diagram of an extruded deformed magnesium matrix composite reinforced with SiC particles obtained in Comparative embodiment 2 of the present application.

The remaining steps are the same as those in Embodiment 1, and the microstructure of the magnesium matrix composite obtained is shown in FIG. 3.

Comparative Embodiment 3

Figure 4:
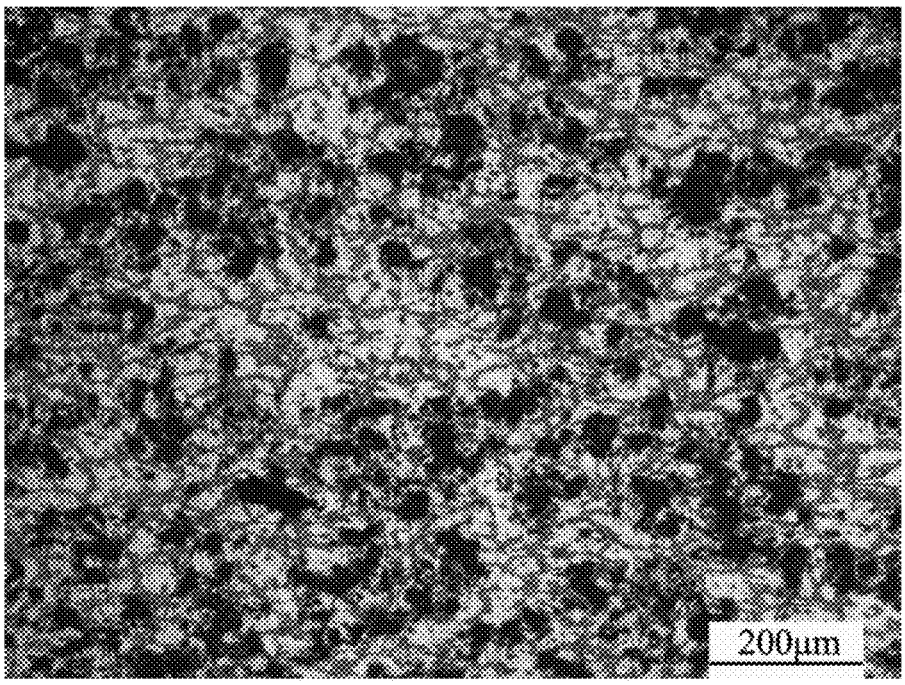
FIG. 4 shows a microstructure diagram of an extruded deformed magnesium matrix composite reinforced with SiC particles obtained in Comparative embodiment 3 of the present application.

Steps (1)-(2) are the same as those in the Embodiment 1;

(3) putting 425 g of the AZ91D magnesium alloy into a crucible for heating; introducing inert gas of $CO_2/SF_6$ with the volume ratio of 6:1 to prevent the magnesium alloy from burning, then heating to 740° C. for complete melting, adding 75 g oxidized SiC particles into the magnesium alloy melt at one time after cinder scrapping, and keeping the temperature for 10 min;

Steps (4) to (6) are the same as those in Embodiment 1, and the microstructure of the obtained magnesium matrix composite is shown in FIG. 4.

Comparative Embodiment 4

The present comparative embodiment is different from Embodiment in that the step (1) of the present comparative embodiment includes: washing SiC particles with alcohol and drying in an incubator at 200° C. for 2 h;

other steps are the same as those in embodiment 1, i.e. no oxidation pretreatment of the SiC particles is carried out.

Figure 5:
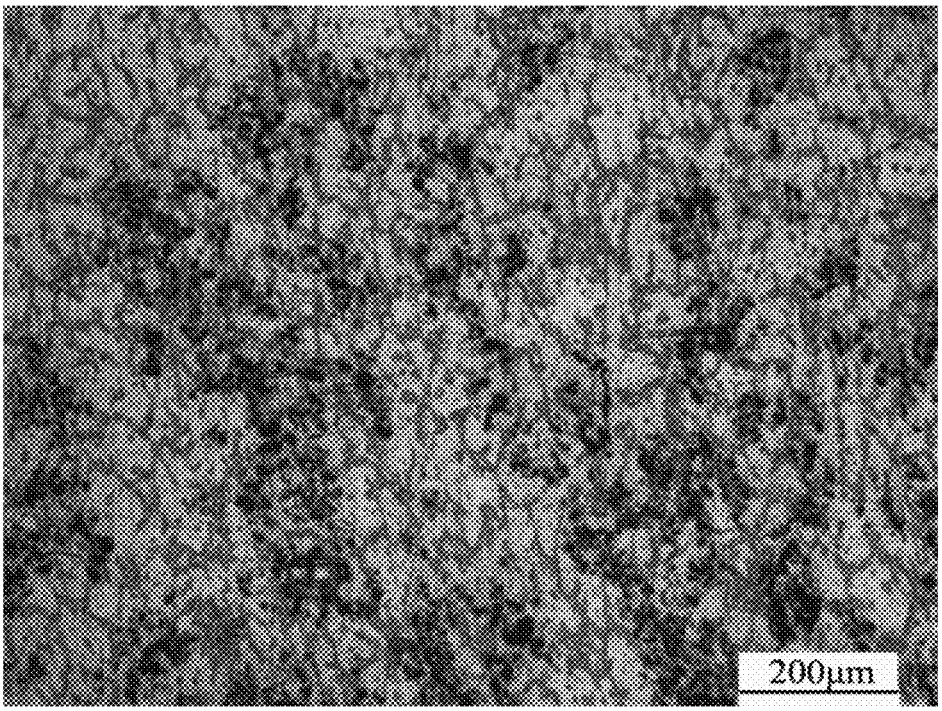
FIG. 5 shows a microstructure diagram of an extruded deformed magnesium matrix composite reinforced with SiC particles obtained in Comparative embodiment 4 of the present application.

The remaining steps are the same as in Example 1. That is, SiC particles are not pretreated by oxidation. The microstructure of the obtained magnesium matrix composite is shown in FIG. 5.

The mechanical properties of the magnesium matrix composites prepared in Embodiment 1 and Comparative embodiments 1-4 are tested, with specific test results as shown in Table 1 (test standard: GB/T10623-2008):

Table 1 Mechanical properties of magnesium matrix composites prepared in Embodiment 1 and

| Comparative embodiments 1-4 | | | |
|---|---|---|---|
| | Tensile strength $\sigma_b$ (MPa) | Tensile rate $\delta$ (%) | Hardness HV |
| Embodiment 1 | 315 | 5.15 | 132.4 |
| Comparative embodiment 1 | 285 | 9.82 | 88.6 |
| Comparative embodiment 2 | 273 | 3.48 | 126.1 |
| Comparative embodiment 3 | 128 | 1.31 | 102.3 |
| Comparative embodiment 4 | 176 | 2.80 | 125.6 |

By comparing the microstructures and mechanical properties of the magnesium matrix composites of Embodiment 1 and Comparative embodiment 1, it can be seen that the structure of the magnesium matrix composites reinforced with SiC particles prepared by the preparation method of the present application is significantly improved, and the tensile strength and hardness of the composites are greatly improved; a comparison of the microstructure and mechanical properties of the magnesium matrix composites of Embodiment 1 and Comparative embodiment 2 demonstrates that the microstructure of Comparative embodiment 2 shows a slight agglomeration in the distribution of SiC particles, whereas the oxidation pretreatment of SiC at the appropriate temperature in Embodiment 1 results in a more uniform distribution of SiC particles in the magnesium alloy tissue and an improvement in the mechanical properties; by comparing the microstructure and mechanical properties of the magnesium matrix composites in Embodiment 1 and Comparative embodiment 3, it can be seen that the conventional way of adding SiC in Comparative embodiment 3 tends to cause serious agglomeration of SiC particles on the magnesium alloy tissue, resulting in serious deterioration of the magnesium alloy grain structure, which in turn seriously impairs the mechanical properties of the magnesium alloy; and a comparison of the microstructure and mechanical properties of the magnesium matrix composites of Embodiment 1 and Comparative embodiment 4 shows that the distribution of SiC particles in the tissue of Comparative embodiment 4 appears agglomerated and uneven, whereas the magnesium matrix composites with oxidation pretreatment of SiC in Embodiment 1 have a more uniform distribution of SiC particles, a more optimized tissue and better mechanical properties.

The above mentioned are only preferred specific embodiments of the present application and the scope of protection of the present application is not limited thereto. Any equivalent substitution or change made by any person skilled in the art according to the technical schemes of the present application and its inventive concept within the technical scope disclosed herein shall be covered by the scope of protection of the present application.

What is claimed is:

1. A preparation method of a magnesium matrix composite reinforced with SiC particles, comprising steps as follows:

(1) carrying out oxidation pretreatment on the SiC particles;

(2) laying a piece of magnesium alloy on a bottom, laying a layer of oxidized SiC particles obtained in the step (1), then repeating a laying operation of a layer of a magnesium alloy and a layer of the SiC particles until magnesium alloys and the SiC particles are completely laid, then introducing inert gases, heating and melting, and then performing cinder scrapping;

(3) cooling to a semisolid temperature of the magnesium alloys for semisolid mechanical stirring, heating, and mechanically stirring again;

(4) cooling again to the semisolid temperature of the magnesium alloys, then casting into a blank; and (5) heating the blank to the semisolid temperature of the magnesium alloys and extruding to obtain the magnesium matrix composite reinforced with the SiC particles;

wherein in the step (1), the oxidation pretreatment comprises oxidation at 1,200 degrees Celsius for 1 hour;

in the step (2), the inert gases are $CO_2/SF_6$ mixed gases with a volume ratio of 6:1; and the heating comprises a process of heating to a temperature of 740 degrees Celsius to completely melt the magnesium alloys and then performing the cinder scrapping;

in the step (2), the SiC particles are in a mass ratio of 3:17 to the magnesium alloys, each layer of the SiC particles has a thickness of 1-2 millimeters, and each layer of the magnesium alloys has a thickness of 10-15 millimeters, with a top layer of magnesium alloy;

in the step (3), the semisolid mechanical stirring comprises stirring for a duration of 30 minutes with a stirring speed of 400 revolutions per minute; the semisolid temperature is 585 degrees Celsius; the heating is to heat to 720 degrees Celsius; and the mechanically stirring again comprises stirring for a duration of 5 minutes with a stirring speed of 400 revolutions per minute; and in the step (5), conditions of the extruding comprise an extrusion pressure of 2,000 kilonewtons, an extrusion speed of 1 millimeter per second, and a pressure holding duration of 1 minute.

2. The preparation method of a magnesium matrix composite reinforced with SiC particles according to claim 1, wherein in the step (4), a temperature is kept for 15 minutes before cooling.

3. A magnesium matrix composite reinforced with SiC particles prepared by the preparation method according to claim 1.

* * * * *